US007080590B2

(12) United States Patent
Nielsen et al.

(10) Patent No.: US 7,080,590 B2
(45) Date of Patent: Jul. 25, 2006

(54) VALVE ARRANGEMENT AND HYDRAULIC DRIVE

(75) Inventors: Brian Nielsen, Soenderborg (DK); Poul Erik Hansen, Gjern (DK); Torben Ole Andersen, Aalborg (DK)

(73) Assignee: Sauer-Danfoss ApS, Nordborg (DK)

( * ) Notice: Subject to any disclaimer, the term of this patent is extended or adjusted under 35 U.S.C. 154(b) by 3 days.

(21) Appl. No.: 10/930,332

(22) Filed: Aug. 31, 2004

(65) Prior Publication Data

US 2005/0051024 A1 Mar. 10, 2005

(30) Foreign Application Priority Data

Sep. 3, 2003 (DE) ..... 103 40 505

(51) Int. Cl.
*F15B 13/04* (2006.01)

(52) U.S. Cl. ..... 91/444; 91/464; 91/455

(58) Field of Classification Search ..... 91/444, 91/454, 455, 464
See application file for complete search history.

(56) References Cited

U.S. PATENT DOCUMENTS 4,572,238 A * 2/1986 Stenlund ..... 91/455
4,611,528 A * 9/1986 Nanda et al. ..... 91/455
4,840,111 A 6/1989 Garnjost
5,138,838 A 8/1992 Crosser
5,568,759 A 10/1996 Aardema
5,960,695 A 10/1999 Aardema et al.
6,354,185 B1 * 3/2002 Sturman ..... 91/454
6,467,264 B1 10/2002 Stephenson et al.

FOREIGN PATENT DOCUMENTS

WO WO 96/27051 9/1996

* cited by examiner

*Primary Examiner*—Edward K. Look
*Assistant Examiner*—Michael Leslie
(74) *Attorney, Agent, or Firm*—McCormick, Paulding & Huber LLP

(57) ABSTRACT

The invention concerns a valve arrangement for controlling a hydraulic drive having a first working connection (A) and a second working connection (B), and being connectable with or separable from a pressure source (P), the supply and the outflow of the hydraulic drive being separately controllable. It is endeavoured to improve the energetic efficiency of the valve arrangement. For this purpose, the first working connection (A) is connected with a first control valve and the second working connection (B) is connected with a second control valve, the first and the second control valves being connected with each other and with a third control valve, which is connected with a tank.

18 Claims, 1 Drawing Sheet

VALVE ARRANGEMENT AND HYDRAULIC DRIVE

CROSS-REFERENCE TO RELATED APPLICATIONS

This application is entitled to the benefit of and incorporates by reference essential subject matter disclosed in German Patent Application No. 103 40 505.4 filed on Sep. 3, 2003.

FIELD OF THE INVENTION

The invention concerns a valve arrangement for controlling a hydraulic drive having a first working connection and a second working connection, and being connectable with or separable from a pressure source, the supply and the outflow of the hydraulic drive being separately controllable. Further, the invention concerns a hydraulic drive, which is controllable by means of a valve arrangement.

BACKGROUND OF THE INVENTION

From the general state of the art, valve arrangements for controlling hydraulic drives are known, in which the control openings for controlling the supply and the outflow of the hydraulic drive are mechanically or hydraulically connected with each other. However, such valve arrangements have the disadvantage that at the working connection serving as inlet, a cavitation may occur. The cavitation and a too high speed of the inlet-controlled drive has until now been avoided by a heavy throttling of the outflow of the hydraulic drive. This heavy throttling, however, results in a poor energetic efficiency. As a solution to this problem, EP 0 809 737 B1, U.S. Pat. No. 5,138,838, U.S. Pat. No. 5,568,759 and U.S. Pat. No. 5,960,695 suggest valve arrangements, with which the supply and the outflow of the hydraulic drive can be controlled separately. These solutions, however, do not meet the heavy requirements with regard to low leakage flows of the working connections, when the valves are not activated. When a load to be moved by the hydraulic drive and the speed of the drive act in the same direction, the solutions in the disclosures mentioned suggest controlling the speed by acting upon the drive with a relatively high oil pressure, which also causes a poor efficiency. U.S. Pat. No. 4,840,111 and U.S. Pat. No. 6,467,264 attempt to solve this problem in that they dispense from a high oil pressure from the supply line. However, these solution proposals require an unnecessarily high pressure in the tank pipe to avoid the cavitation when lowering the load and at the same time to require no hydraulic fluid from the pump pipe. The high pressure in the tank pipe, however, causes throttling losses, which again result in a poor energetic efficiency.

The task of the invention is to substantially improve the energy efficiency in connection with the above-described valve arrangement.

SUMMARY OF THE INVENTION

The present invention employs a first working connection connected with a first control valve and a second working connection connected with a second control valve, the first and the second control valves being connected with each other and with a third control valve, which is connected to a tank.

By means of a corresponding switching of the first and the second control valves, to connect the two working connections hydraulically with each other, so that the hydraulic fluid coming from the hydraulic drive through one working connection is re-supplied to the hydraulic drive through the second working connection. This is particularly advantageous when lowering a load, as then a pump pressure no longer has to be applied on the hydraulic drive. Further, a control of the speed of the hydraulic drive is possible through the third control valve. If a reduction of the lowering speed is desired, the third control valve, which leads to the tank pipe, is closed some more. If, on the other hand, an increase of the lowering speed is desired, the third control valve is opened some more, so that now more hydraulic fluid can flow off to the tank and less hydraulic fluid is re-supplied to the hydraulic drive. Returning the hydraulic fluid from one working connection to the other working connection is, however, also advantageous when lifting a load acting upon the hydraulic drive. In order to lift the load, the hydraulic drive is acted upon at the corresponding working connection by a certain pressure from the pump, so that, caused by the movement of the hydraulic drive hydraulic fluid will flow off at the other working connection, said hydraulic fluid being re-supplied via the first and the second control valves to the working connection used as inlet. Further, it is possible to throttle the first or the second control valves in accordance with the desired speed. Thus, the valve arrangement according to the invention makes it possible, both when lifting and lowering a load, to save a substantial amount of energy because of the returning of hydraulic fluid from one working connection to the other working connection, which also substantially improves the energetic efficiency. Alternatively to the third control valve, a pressure relief valve may be provided, which can be set at the pressure at the first working connection.

In a preferred embodiment, the first, the second and the third control valves are 2/2-way valves. These 2/2-way valves are simple standard components, so that the valve arrangement can be realised in a cost-effective manner.

For measuring a pressure at the first working connection, the valve arrangement expediently has a first pressure sensor, and a second pressure sensor at the second working connection. Further, it is suitable, when the third control valve is provided with a position transmitter, and when a third pressure sensor is located in a tank pipe between the tank and the third control valve. Thus, all required valve openings can be set exactly to the respective, required operating conditions.

In a further embodiment of the invention, the valve arrangement has a control valve, which is a 3/3-way valve, controlling the supply. This 3/3-way valve is also a simple and thus cost-effective standard component, with which certain throttling positions for an exact setting of the valve arrangement can be reliably realised.

Expediently, the control valve controlling the supply is provided with a position transmitter. Further, a fourth pressure sensor can be located in a pump pipe between the pump and the control valve controlling the supply. Thus, the control valve controlling the supply, the position transmitter and the fourth pressure sensor permit an exact setting of the supply amount to the hydraulic drive in accordance with instantly desired operating conditions.

The valve arrangement can have two supply pipes, through which the hydraulic drive is supplied with hydraulic fluid. Further, a backflow preventer, for example a non-return valve, can be located in each supply pipe. The backflow preventer prevents an undesired lowering of a load to be lifted by avoiding an undesired leakage flow from one working connection to the other.

The valve arrangement for the supply control can be provided with a mechanical differential pressure controller or an electronic measuring and control device for controlling the hydraulic supply to the hydraulic drive.

The control valves can be adjustable directly and/or through a pressure control and/or through a control of the valve position. Thus, the valve arrangement is particularly suited for being programmed to certain operation modes.

Preferably, the valve arrangement has at least one electronic device for controlling the flow. Thus, several desired operation modes of the valve arrangement can be programmed and carried through on need.

The following program steps can be performed in the electronic device:

- Determination of a differential pressure between a pressure in the pump pipe and a pressure at the working connection
- Feedback of the differential pressure to an inverse valve model for determination of the desired valve opening
- Calculation of a difference between a desired and a measured valve opening.

For controlling the outflow to the tank, the valve arrangement can have at least one microprocessor, which interacts with the pressure sensor at the first working connection and with the third control valve. Via the microprocessor, the valve arrangement can also be programmed for certain operation modes, primarily to avoid a cavitation at the first working connection. Of course, the microprocessor can also interact with other sensors and valves. The expedient connections between the microprocessor, the valves and the sensors depend on the selected application.

In order to simplify as much as possible the total design of the valve arrangement, the valve arrangement can be assembled in one or more valve blocks.

Preferably, the hydraulic motor can be a rotation motor or a translation motor.

BRIEF DESCRIPTION OF THE DRAWINGS

In the following, an embodiment of the invention is explained in detail on the basis of the enclosed drawings, showing.

DETAILED DESCRIPTION OF THE PREFERRED EMBODIMENTS

Figure 1:
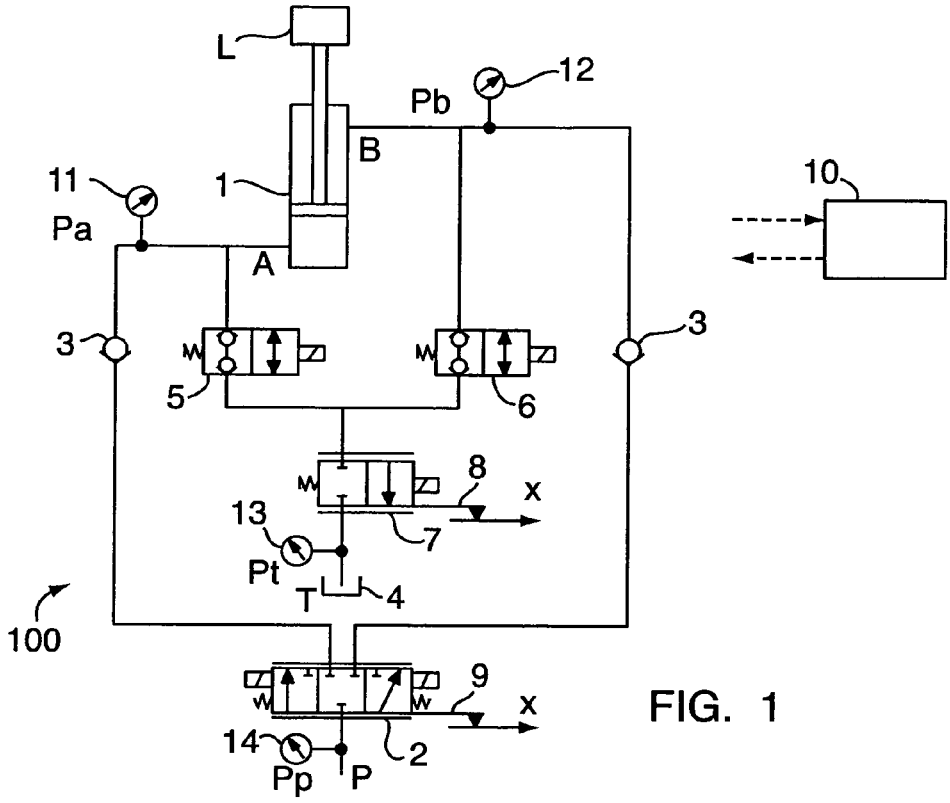
FIG. 1 is a schematic view of a valve arrangement according to the invention

FIG. 1 shows a valve arrangement 100 for controlling a hydraulic drive 1. The valve arrangement 100 has a control valve 2, which is a 3/3-way valve, and control valves 5, 6 and 7, which are 2/2-way valves. Via a pump P, hydraulic fluid is supplied to the working connections A or B of the hydraulic drive 1 through the control valve 2 and the backflow preventers 3, which are non-return valves. The return flow from the hydraulic drive 1 to a tank 4 occurs through the control valves 5, 6 and 7. The control valves 5 and 6 are controllable as non-return valves in both flow directions to prevent an undesired leakage flow from the working connection A to the working connection B and from the working connections A and B to the tank 4. Together with the non-return valves 3, the leakage flow at the working connections A and B is neglectably small. Further, the backflow preventers 3 prevents that during lifting the load can suddenly drop. The control valves 2, 5, 6 and 7 are, for example, provided with a solenoid coil drive. However, also other drive possibilities for the control valves 2, 5, 6 and 7 are possible. The control valves 2, 5, 6 and 7 can also be activated by a hydraulic control pressure. This means that they can exist in the form of pilot-controlled hydraulic valves. Further, the control valves 2, 5, 6 and 7 are provided with a reset spring to be able to interrupt the flow on a failure of the valve drive. Further, the control valve 2 has a position transmitter 9 and the control valve 7 has a position transmitter 8. Between the pump P and the control valve 2 is located a pressure sensor 14, at the working connections A and B a pressure sensor 11 and 12, and between the tank 4 and the control valve 7 a pressure sensor 13. For activating the control valve 7, a microprocessor 10 interacts with the pressure sensor 11. The microprocessor can also interact with other sensors, for example with all sensors. However, all sensors shown in the figure are not always required. The application selected decides, which sensors are expedient.

Figure 2:
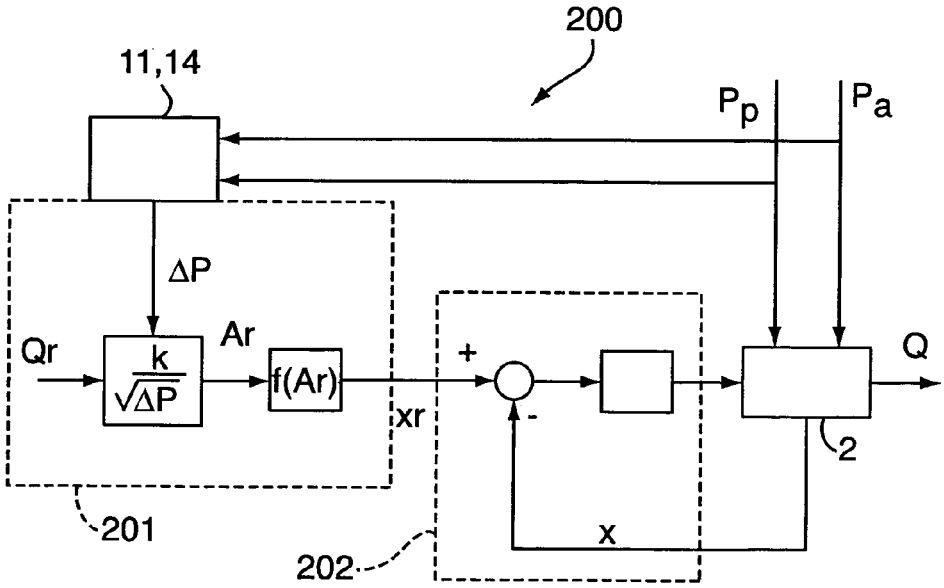
FIG. 2 is a schematic view of an electronic device for valve control

FIG. 2 shows a device 200 for measuring and controlling the flow, here used for measuring and controlling the supply to the hydraulic drive 1. The pressure sensors 11 and 14 measure a pressure $P_a$ at the working connection A and a pressure $P_p$ at the pressure connection P. In an evaluator 201, the differential pressure of the two pressures $P_p$ and $P_a$ is determined. The determined differential pressure is fed back to an inverse valve model for determination of the desired valve opening, so that the desired valve opening $A_r$ for a desired flow $Q_r$ can be calculated. A value k represents a valve constant. Due to the inverse flow characteristic $x_r=f(A_r)$, it is possible to determine the desired valve position $x_r$. A device 202 for changing the valve position uses a difference between the desired valve position $x_r$ and the measured valve position x. When $x=x_r$, the reference flow $Q_r$ is equal to the flow Q to be controlled, independently of the pressure generated by a load L. For this control of the valve position, the pressure sensors 11 and 14 and the position transmitter 9 are required. When a load L at the hydraulic drive 1 acts against the movement direction, also the pressure sensor 12 (FIG. 1) is required.

With the relatively simple valve arrangement 100 and the valve control 200 a number of multiplex operation modes are possible. In a first operation mode, the hydraulic fluid can flow from P to the working connection A and from the working connection B to T. In a first possibility for controlling the flow amount, the control valve 2 controlling the supply is set according to the desired flow amount, to determine the supply to the working connection A. The control valve 7 can also be set according to the desired outflow amount, to determine the amount to be returned to the tank 4. In this operation mode, the control valve 5 is closed and the control valve 6 is open, to enable a direct flow from the working connection B to the tank 4. With this operation mode, the flow can, for example, occur through a flow amount control, a control of the position of the hydraulic drive or a pressure control. Further control possibilities, which are known to a person skilled in the art, are, however, also possible with the valve arrangement 100. In the following, the flow amount control, the control of the valve position and the pressure control are described.

The control of the flow amount is often preferred with mobile applications, for example with backhoes or cranes, as then an operator can change the speed independently of the load to be lifted or lowered. With the flow amount control, the flow to the working connection A is controlled. The control of the flow amount can either be made in the conventional way through a mechanical differential pressure control, not shown in detail, or, as described in FIG. 2, through an electronic unit 200 for measuring and controlling the flow amount. In order to prevent that the load L to be moved starts moving ahead independently, thus causing cavitation, the pressure at the working connection A must be kept at a certain level by the control valve 7 controlling the outflow. This can either take place electronically through the pressure sensor 11 and the microprocessor 10, or alternatively through a mechanically working pressure relief valve, not shown in detail, which replaces the control valve 7. With the pressure relief valve, the pressure $P_a$ acting at the working connection A is preset.

A second possibility of controlling the flow amount is the control valve 7. In this case, the pressure $P_b$ ruling at the working connection B must be high enough to ensure the required flow through the valve 7. Therefore, the control valve 2 controls the pressure $P_b$ ruling at the working connection B by means of the pressure sensor 12 and the microprocessor 10. In order to avoid a cavitation at the working connection A, the control valve 2 controlling the supply is also used to keep the pressure $P_a$ ruling at the working connection A at a certain level. The outflow from the hydraulic drive 1 can take place according to the control shown in FIG. 2. In this case, the differential pressure results from the difference between the pressure $P_b$ at the working connection B and the pressure $P_t$ measured by the pressure sensor 13. The position transmitter 8 determines the valve position of the control valve 7. When $P_t$ is low, known or constant, the pressure sensor 13 can be omitted. However, the pressure sensors 11 and 12 are required to control the flow amount in both flow directions.

In automatically controlled hydraulic arrangements, a control of the position of the hydraulic drive is often used. Here, the speed is controlled indirectly via the inclination of a reference position profile. In order to prevent the load from independently moving ahead, thus causing a cavitation, the valve 2 controlling the supply can control the position of the hydraulic drive 1, and the valve 7 controlling the outflow can control the pressure at the working connection B. Alternatively, for controlling the position of the hydraulic drive 1, it is also possible that the valve 7 controlling the outflow controls the position of the hydraulic drive 1, and the valve 2 controlling the supply is used to keep the pressure at the working connection B at a sufficient pressure level. To prevent the load L from moving ahead and to prevent cavitation at the working connection A, the control valve 2 controlling the supply is used to keep the pressure $P_a$ at the working connection A at a certain level.

In a pressure control, it is possible to control both the pressure $P_a$ at the working connection A and the pressure $P_b$ at the working connection B. When the differential pressure of $P_b$ and $P_a$ is controlled for driving the hydraulic drive 1, $P_a$ or $P_b$ can be kept low, thus saving energy and keeping the energetic efficiency at a favourable level.

When, in the valve arrangement 100 (FIG. 1), the hydraulic fluid flows from P to B and from A to T, the control possibilities described for a flow from P to A and B to T can also be used. The only difference is that the control valve 2 controls the flow to the working connection B and the control valve 7 controlling the outflow controls the outflow from the working connection A back to the tank 4. The control valve 5 is then open, and the control valve 6 is closed to enable an outflow from the working connection A to the tank 4.

In a further operation mode, undesirable leakage flows are avoided. Leakage flows are, for example, undesirable, when the hydraulic drive 1 has to hold the load L in a certain position for a long period. This is achieved by means of the backflow preventers 3 and the control valves 5 and 6, which can also be set to be backflow preventers, in that they block the flow. The control valves 2 and 7 are also closed.

In an alternative operation mode, in which the hydraulic drive 1 is not exposed to a pressure from the pump P, the hydraulic fluid can be pushed through the hydraulic pipes by the weight of the load L to be lowered. For this purpose, the control valve 2 interrupts the flow and the control valves 5, 6 and 7 are open. Thus, the working connections A and B are connected with each other and with the tank 4, so that the low tank pressure rules at both working connections A and B.

Another operation mode, for example in connection with a jerk-like pulling movement, is achieved in that the cylinder position of the hydraulic drive 1 is controlled and a pressure relief is provided. Such an operation mode, for example, occurs in a tractor, particularly when controlling the toolbar of a tractor, which carries, for example, a plough. For controlling the cylinder position when lifting a load L, hydraulic fluid is supplied to the hydraulic drive 1 at the working connection A, and when lowering a load L, hydraulic fluid is returned to the working connection B from the working connection A via the control valves 5 and 6. A pressure control keeps the pressure $P_b$ under a certain pressure level by means of the control valve 7. The control valve 2 supplies hydraulic fluid to the hydraulic drive 1, which keeps the pressure $P_a$ at a lower level to prevent cavitation. For this operation mode, the pressure sensors 11 and 12 and the position transmitters 8 and 9 are required.

In an also possible operation mode, the lowering of a load L requires neither a flow generated by the pump nor a pressure generated by the pump, so that energy is saved. The flow is ensured directly through a connection of the working connections A and B by opening the valves 5 and 6. The cylinder speed of the hydraulic drive 1 is influenced by an outflow control by the valve 7. During this procedure, the control valve 2 is closed. For this mode of operation, the pressure sensor 11 and, when a very accurate control of the flow is required, also the pressure sensor 13 are required, together with the position transmitter 8, to control the outflow. In order to avoid a heavy pressure drop, the control valves 5 and 6 can be throttled.

The return from one working connection to the other working connection can also be used when lifting the load L. Connecting the working connection A with the working connection B increases the cylinder speed, as the flow supplied by the pump at the working connection A will be added to the return flow from the working connection B to the working connection A by opening or throttling the control valve 2. In this operation mode, the valve 7 is closed. When a low speed is desired, the control valve 7 can be opened in a throttling position, so that hydraulic fluid flows to the tank 4. In order to prevent the load L from moving ahead independently, the control valves 5 or 6 can be throttled. The use of the control valves 5 and 6, the microprocessor 10 and the pressure sensor 11 makes it possible to keep the pressure $P_a$ at the working connection A at a certain pressure level.

What is claimed is:

1. A valve arrangement for controlling a hydraulic drive, the valve arrangement comprising:

a first working connection;

a second working connection;

a pressure source connection;

a tank outlet connection;

a first control valve, being a first on/off valve controllable in two flow directions and connected with the first working connection;

a second control valve, being a second on/off valve controllable in two flow directions and connected with the second working connection and the first control valve; and a third control valve connected with the first and the second control valves and connected with the tank outlet connection;

wherein the valve arrangement is adapted to separately control a supply and an outflow of the hydraulic drive.

2. The valve arrangement according to claim 1, wherein the control valves are 2/2-way valves.

3. The valve arrangement according to claim 1, wherein the valve arrangement has a first pressure sensor for measuring a pressure at the first working connection.

4. The valve arrangement according to claim 3, wherein the valve arrangement has a second pressure sensor for measuring a pressure at the second working connection.

5. The valve arrangement according to claim 4, wherein the tank outlet connection includes a tank pipe between a tank and the third control valve, and a third pressure sensor is located in the tank pipe.

6. The valve arrangement according to claim 1, wherein the third control valve has a position transmitter.

7. The valve arrangement according to claim 1, wherein the valve arrangement has a fourth control valve, which is a 3/3-way valve, controlling the pressure source connection.

8. The valve arrangement according to claim 7, wherein the fourth control valve is provided with a position transmitter.

9. The valve arrangement according to claim 5, wherein the valve arrangement has a fourth control valve, which is a 3/3-way valve, controlling the pressure source connection, the pressure source connection includes a pump and the fourth control valve, and a fourth pressure sensor is located in the pump pipe.

10. The valve arrangement according to claim 1, wherein the valve arrangement has two supply pipes, adapted to supply the hydraulic drive with hydraulic fluid, a backflow preventer being located in each supply pipe.

11. The valve arrangement according to claim 1, wherein the control valves are adjustable directly and/or by pressure control and/or by a control of the valve position.

12. The valve arrangement according to claim 1, wherein the valve arrangement has a mechanical differential pressure controller for controlling the supply to the hydraulic drive.

13. The valve arrangement according to claim 1, wherein the valve arrangement has an electronic device for controlling the supply to the hydraulic drive.

14. The valve arrangement according to claim 13, wherein the valve arrangement performs at least one of the following program steps:

a. determination of a differential pressure between a pressure in a pump pipe and a pressure at the first working connection;

b. feedback of the differential pressure to an inverse valve model for determination of the desired valve opening; and c. calculation of a difference between a desired and a measured valve opening.

15. The valve arrangement according to claim 3, wherein the valve arrangement has at least one microprocessor, which interacts with the first pressure sensor, for controlling an outflow to the tank.

16. The valve arrangement according to claim 1, wherein the valve arrangement is assembled in one or more valve blocks.

17. The valve arrangement according to claim 1, further comprising hydraulic drive and wherein the hydraulic drive is a rotation motor or a translation motor.

18. The valve arrangement of claim 1, wherein the third control valve controls the outflow of the hydraulic valve.

* * * * *

UNITED STATES PATENT AND TRADEMARK OFFICE

CERTIFICATE OF CORRECTION

PATENT NO. : 7,080,590 B2
APPLICATION NO. : 10/930332
DATED : July 25, 2006
INVENTOR(S) : Nielsen et al.

It is certified that error appears in the above-identified patent and that said Letters Patent is hereby corrected as shown below:

In column 7, claim 9, line 26, after the word "a", please insert --pump pipe between a--.

Signed and Sealed this

Twenty-fourth Day of July, 2007

JON W. DUDAS
*Director of the United States Patent and Trademark Office*